US007614825B2

(12) United States Patent
Kroger

(10) Patent No.: US 7,614,825 B2
(45) Date of Patent: Nov. 10, 2009

(54) DEPLOYABLE CONTAINMENT SYSTEM

(75) Inventor: David G. Kroger, Hudson, OH (US)

(73) Assignee: Polystar Incorporated, Twinsburg, OH (US)

( * ) Notice: Subject to any disclaimer, the term of this patent is extended or adjusted under 35 U.S.C. 154(b) by 173 days.

(21) Appl. No.: 11/836,240

(22) Filed: Aug. 9, 2007

(65) Prior Publication Data

US 2009/0041543 A1 Feb. 12, 2009

(51) Int. Cl.
*B65D 25/00* (2006.01)
*E04H 4/04* (2006.01)

(52) U.S. Cl. ..... 405/107; 220/476; 405/114

(58) Field of Classification Search ..... 405/107, 405/110, 114; 52/169.7; 220/476
See application file for complete search history.

(56) References Cited

U.S. PATENT DOCUMENTS

| | | | | |
|---|---|---|---|---|
| 4,031,676 | A | 6/1977 | Dally | |
| 4,765,775 | A * | 8/1988 | Kroger | 405/52 |
| 4,865,213 | A | 9/1989 | Kruger | |
| 4,869,617 | A | 9/1989 | Chiodo | |
| 4,978,245 | A * | 12/1990 | White | 404/6 |
| 5,176,468 | A | 1/1993 | Poole | |
| 5,230,582 | A * | 7/1993 | Schmitt et al. | 404/6 |
| RE034,691 | E | 8/1994 | White | |
| 5,454,195 | A | 10/1995 | Hallsten | |
| 5,632,573 | A | 5/1997 | Baker | |
| 5,689,920 | A * | 11/1997 | Hallsten | 52/169.1 |
| 5,836,714 | A * | 11/1998 | Christensen | 404/6 |
| 5,984,577 | A | 11/1999 | Strong | |
| 6,004,067 | A | 12/1999 | Peppard | |
| 6,059,491 | A | 5/2000 | Striefel et al. | |
| D431,082 | S | 9/2000 | Jaros | |
| 6,164,870 | A | 12/2000 | Baruh | |
| 6,588,979 | B1 | 7/2003 | Pasij | |
| 6,612,777 | B2 * | 9/2003 | Maestro | 405/49 |
| 6,672,800 | B2 | 1/2004 | Frank | |
| 6,695,534 | B2 * | 2/2004 | Cain et al. | 405/52 |
| 2002/0110424 | A1 | 8/2002 | Page | |
| 2003/0161688 | A1 | 8/2003 | Frank | |

* cited by examiner

*Primary Examiner*—John Kreck
(74) *Attorney, Agent, or Firm*—Pearne & Gordon LLP

(57) ABSTRACT

A modular dike assembly includes strut and corner members that may be interconnected to form a barrier or dike wall surrounding a primary container. The strut members are stackable for convenience in transporting the system and an alignment web is provided for defining the interior perimeter of the closed barrier or dike wall and to secure assembled members together.

23 Claims, 5 Drawing Sheets

DEPLOYABLE CONTAINMENT SYSTEM

BACKGROUND OF THE INVENTION

The present invention relates generally to secondary containment systems typically used in connection with hazardous materials or other materials to be isolated from the environment. More particularly, a deployable modular containment system includes strut and corner members that may be interconnected to form a closed barrier or dike wall surrounding a primary container. The strut members are stackable for convenience in transporting the system and an alignment web is provided for defining an inside or interior perimeter of the closed barrier or dike wall and to secure assembled members together.

It is known to use secondary containment systems for reducing, if not eliminating, accidental spill of materials being stored or processed. For example, steel drum storage of hazardous materials may require secondary containment under applicable environmental regulations. Military fuel storage may be provided in a primary container surrounded by a secondary containment system.

Applicant's prior U.S. Pat. No. 4,765,775 discloses a modular containment system employing interlocking strut and corner members that are staked to the substratum following assembly. Although portable, the strut members do not nest and transportation of the system was inhibited by the bulk of the strut members. For example, typical strut member dimensions range from 12 to 16 feet in length, several feet in height and about one foot in width at the base. In the absence of nesting or substantial interfitting engagement, the strut member shipping volume is substantially the sum of the individual strut volumes.

In addition to transportation considerations, it is desirable that the containment system be quickly and easily deployed and assembled. This is particularly true in the case of military applications wherein assembly, disassembly and transportation of the system may be provided at different locations by different personnel. Accordingly, it is important that the system components be limited in number and readily assembled to provide a sturdy construction.

SUMMARY OF THE INVENTION

In accordance with the invention, a modular containment system is provided with a limited number of easily assembled strut and corner components or members. The strut members are stackable with nesting for purposes of storage and/or transportation.

The strut member has a generally truncated triangular cross-section including a top wall connecting spaced side walls that extend to an open base. The side walls of the strut extend lengthwise between connector ends engagable with connector ends of adjacent strut and corner members.

The strut member has a substantially hollow interior. One end of the strut is open and the other end is closed by an end wall that reinforces the strut. The strut is sufficiently rigid to enable it to be manually manipulated with engagement at a limited number of points.

The open base and open end of the strut member cooperate with the hollow interior to provide a structure of reduced weight that may be manually stacked, unstacked and assembled into a barrier or dike by workers. Preferably, the strut members are of identical shape and are closely nested together when stacked. Further, the nesting or engagement of one strut within another is limited by rigid members so that the struts are not substantially flexed and/or frictionally engaged so as to inhibit unstacking.

The alignment web defines the inside or interior perimeter of the dike assembly. The web includes a sheet member for fixing an array of elongate strap members in the manner of a harness. The straps, in turn, connect the strut and corner members and fix their relative positions in the proper dike configuration. That is, the web assures the proper positioning of the strut and corner members and then contributes to the control of their relative positions during use of the dike assembly.

DETAILED DESCRIPTION OF THE INVENTION

Figure 1:
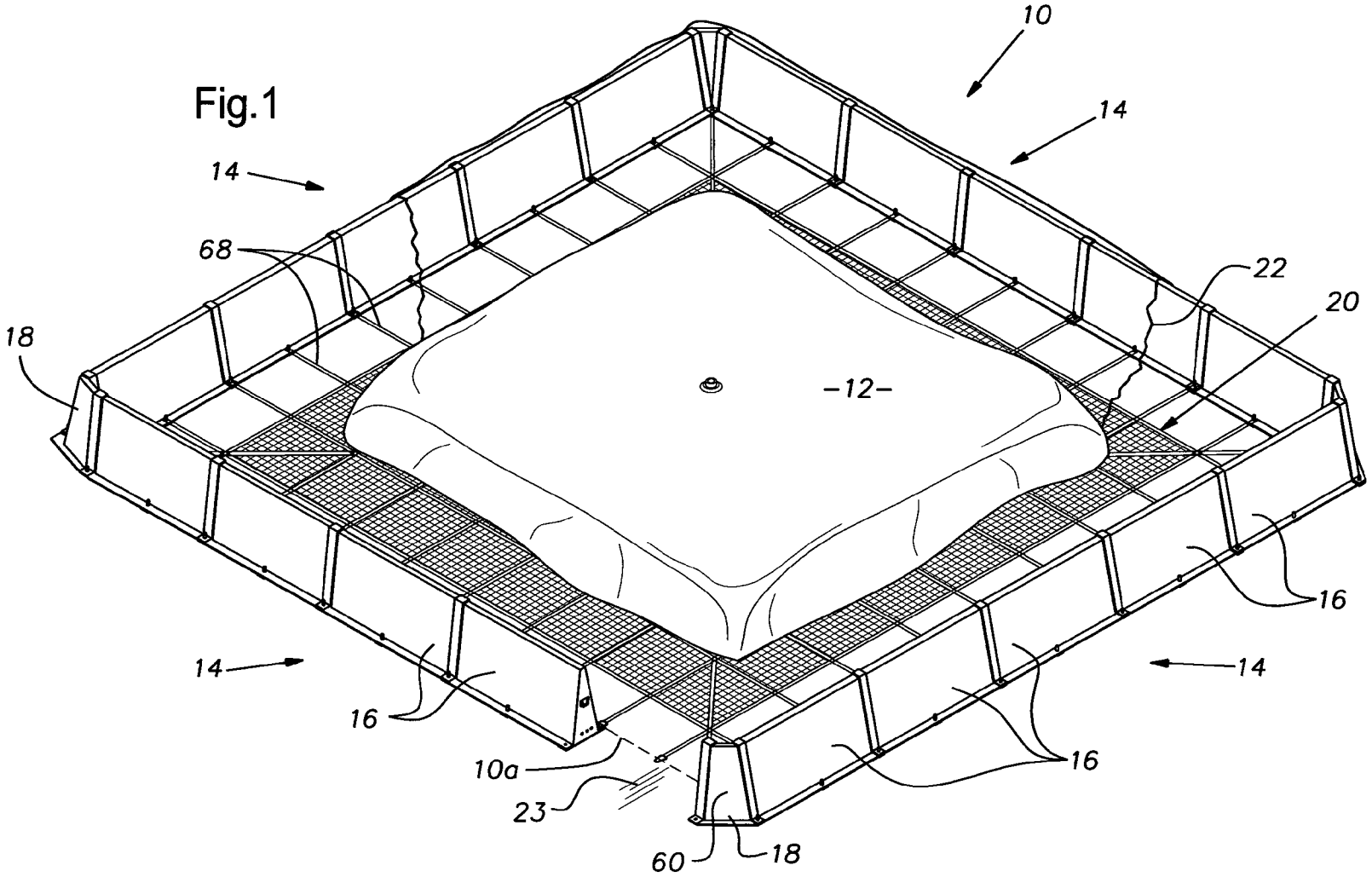
FIG. 1 is an isometric view of a closed dike assembly having strut and corner members in accordance with the invention surrounding a primary container and having parts broken away or omitted for purposes of illustration.

A closed barrier or dike assembly 10 surrounding a primary container 12 is shown in FIG. 1. The primary container 12 is a flexible bladder construction that may contain a fuel to be isolated from the environment in case of container failure or as required by environmental regulations.

The dike assembly 10 has a square configuration provided by opposed dike walls 14 formed by interlocked strut members 16 extending between and interlocked with corner members 18. An alignment web 20 has extremities extending along an interior perimeter 10*a* of the dike assembly 10 and secures the members 16 and 18 together as further explained below.

For purposes of fluid containment, a fluid impermeable barrier film or sheet 22 is disposed between the primary container 12 and the web 20, along the substratum 23 and over the dike walls 14. The sheet 22 may be secured in place by connection to the dike walls or loosely draped over the dike walls and/or optionally secured to the substratum 23 outside the dike assembly.

The sheet 22 is preferably flexible and may be conformed with the interior shape of the dike assembly including the surfaces of the struts and corners as well as the contour of the substratum 23. The sheet 22 may be formed of a suitable plastic material such as polyamide, polyester or polyurethane with or without reinforcement. For clarity of illustration, the sheet 23 is transparent and has been broken away so that only the top left corner of the sheet is shown in FIG. 1. Of course, the sheet 23 may be opaque and/or comprise a fabric/plastic laminate.

Figure 2:
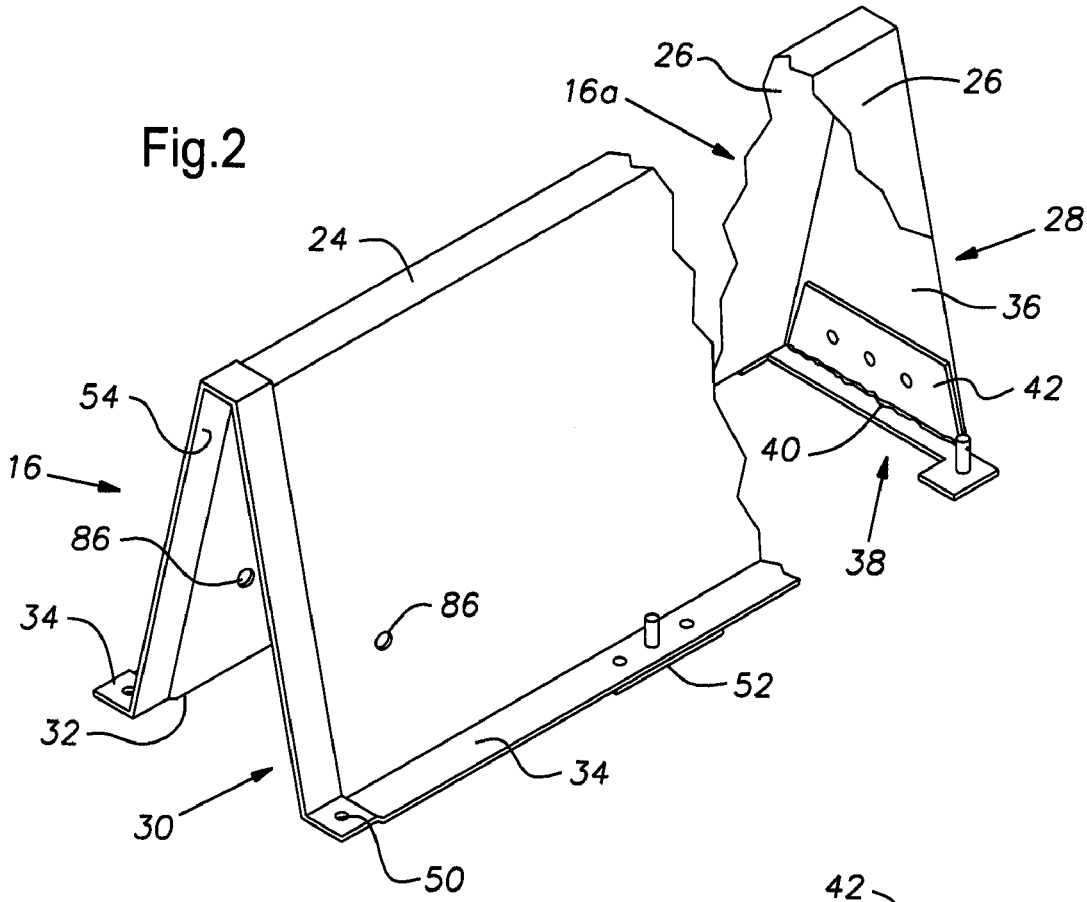
FIG. 2 is an isometric view of a strut member with parts broken away for purposes of illustration.
Figure 3:
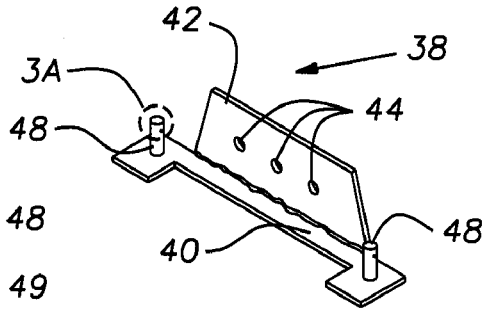
FIG. 3 is an isometric view of an end bracket used to reinforce the male or closed end of the strut.
Figure 4:
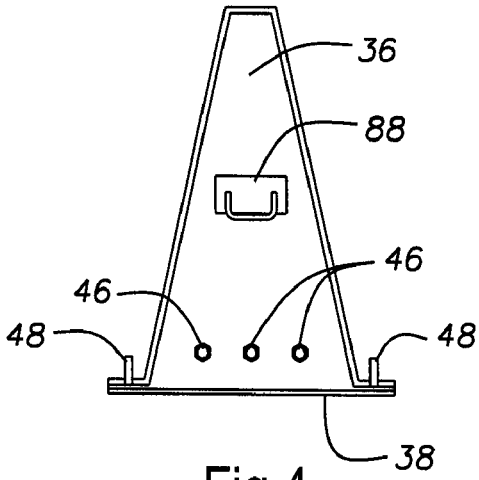
FIG. 4 is an elevational view of the closed end of the strut.

Referring to FIGS. 2 through 4, the strut 16 has a truncated configuration and a hollow interior 16*a*. The strut 16 includes a top wall 24 connecting opposed sidewalls 26. The sidewalls 26 extend in a generally horizontal lengthwise direction between a male connector end 28 and a female connector end 30.

The sidewalls 26 are generally flat and extend along substantially the entire height and length of the strut 16. The sidewalls 26 open or diverge downwardly away from the top wall 24 to form an open strut base 32 that communicates with the hollow interior 16*a* of the strut.

Each of the sidewalls includes an integrally formed flange 34 laterally extending from the bottom edge of the wall along the length of the strut. The flanges 34 form stabilizing support surfaces for the strut and cooperate in the connection of the struts and corners to each other and to the web 20.

The male connector end 28 is closed by an end wall 36 connecting the adjacent ends of the sidewalls 26. The connector end 28 and end wall 36 thereby increase the rigidity of the strut 16.

The strut rigidity is further increased by an end bracket 38 having a U-shape base 40 extending below the lower edge of the end wall 36 and adjacent portions of the flanges 34. An upright reinforcing plate 42 is welded to the base 40. The plate 42 includes bolt holes 44 that align with similar bolt holes (not shown) in the end wall 36 so that the bracket 38 may be secured to the end wall 36 by bolts 46 (FIG. 4).

A rigid pin member 48 projects upwardly from each lateral side of the base 40 of the bracket 38 and extends through an associated flange hole 50 located in the flange 34 adjacent the connector end 28. A mid-base plate 52 is bolted to the bottom of each of the flanges 34 at about the middle of the strut length. Each mid-base plate 52 includes an upwardly projecting pin 48.

Figure 3A:
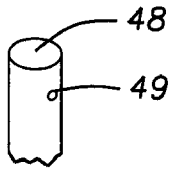
FIG. 3A is a fragmentary isometric view on an enlarged scale taken along the line 3A in FIG. 3.

Each of the pins 48 has a cylindrical shape and includes a diametrically extending fastening hole 49 (FIG. 3A). The pins 48 extend through associated overlying flange holes 50 in adjacent strut and corner members and may be locked therein to secure the strut 16 and corner 18 members together.

The female connector end 30 includes a socket 54 (FIG. 2) extending along the top and sidewalls of the strut. The socket 54 is integrally formed in the end 30 during fabrication of the strut 16.

The socket has an enlarged interior dimension for receiving and interlocking with a male connector end 28. The socket 54 has an interior shape generally conforming with the exterior shape of the male connector end 28 and provides a "bell" fitting in which the latter is received with a snug frictionally locking fit. The male/female connection further enhances the overall rigidity of the dike wall 14.

Figure 5:
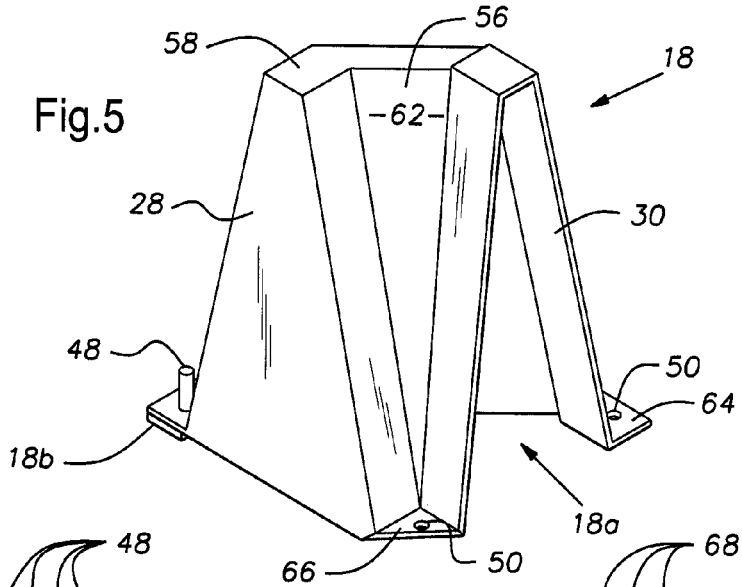
FIG. 5 is an isometric view of a corner member.

Referring to FIG. 5, the corner member 18 includes a connector portion 56 extending at a 45° angle between a male connector end 28 and a female connector end 30. The corner member 18 has a substantially hollow interior 18*a* and includes a top wall 58 connecting an outer wall 60 (FIG. 1) to an inner wall 62. The outer wall 60 has a generally rectangular shape (FIG. 1) and the inner wall 62 has an inverted triangular shape (FIG. 5).

The corner member 18 includes an outer flange 64 and inner flange 66. The flanges are integrally formed with the corner member and provide upright stability similar to the strut flanges 34. The flanges 64 and 66 are provided with flange holes 50 for receiving pins 48 of an adjacent female end 30 of the strut 16 as described below. In addition, a corner base plate 18*b* having a pin 48 is secured to the outside flange 64 at the male connector end 28 as best shown in FIG. 5.

The struts and corners may be formed of a number of different materials including plastic resins such as polyethylene, polypropylene, polyvinyl chloride, polystyrene and polyester as well as recycled plastics and/or inert fillers. Generally, reinforcing materials such as nonwoven and/or woven fibers are included in the plastics. A preferred system comprises an isophthalic polyester reinforced with over lying layers of glass fiber nonwoven and woven materials. The wall thickness may be about 5/16 inch.

The struts 16 and corners 18 are of similar heights and widths to assure connecting assembly to form a dike system. For example, strut top wall 24 may be four inches wide and the sidewalls 26 may diverge to provide the open base 32 with a width dimension of about 20 inches. Each of the flanges 34 has a width dimension of three inches to provide the strut with a 26 inch wide stabilizing foot print. The length of the strut 16 is about eight feet.

The corner 18 is similarly sized and provided with the same connector ends as the struts. Accordingly, the corner member is also provided with a stabilizing foot print in the same manner as the strut.

The struts and corners are modular and various size and shape dike assemblies may be formed with different numbers of members. Further, the strut and corner member dimensions may be varied to provide dike assemblies of corresponding size variations.

Accordingly, the dike assembly 10 may be provided in different sizes and various rectangular shapes by adding or eliminating struts 16 and using an appropriately sized web 20. Of course, the dike structure may be provided with a circular, oval or other arcuate configuration with the use of appropriately curved strut and corner members together with suitable alignment web configurations.

Figure 6:
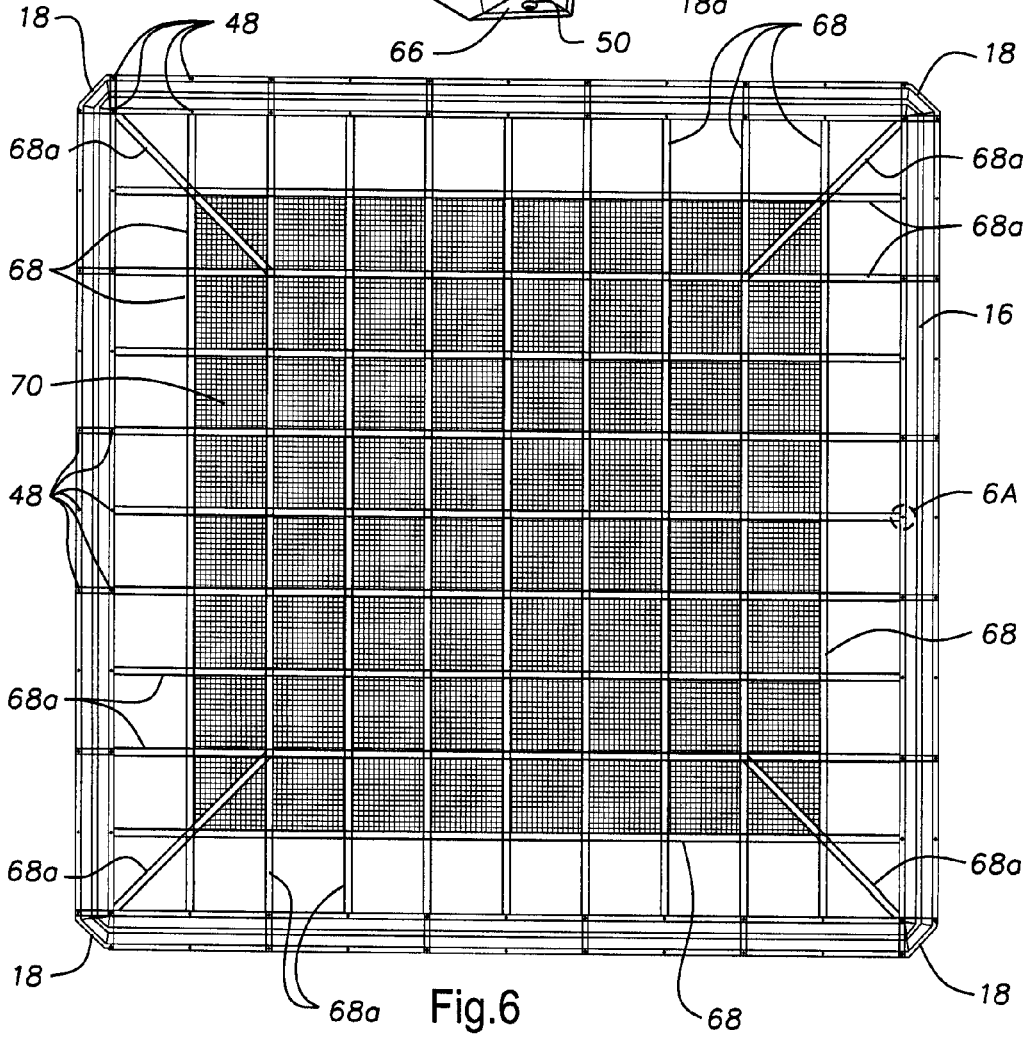
FIG. 6 is a schematic top plan view of the dike and the alignment web shown in FIG. 1.

Referring to FIGS. 1 and 6, the dike assembly 10 is formed about the perimeter of the web 20. For convenience, the dike assembly 10 is considered to have an inside perimeter 10*a* (FIG. 1) extending through the interior flange holes 50 and the pins 48. As explained below, the web 20 has an outer perimeter or extremity which lies on the inside perimeter 10*a* of the dike assembly 10.

The web 20 is formed of an array of flexible straps 68 secured to a flexible sheet 70. The straps 68 include end portions or pigtails 68*a* that extend beyond the edges of the sheet 70.

The sheet 70 may be formed of a fabric or netting, plastic sheeting or combinations thereof. For example, a polyethylene tarp having a weight of 7 oz./sq. yd. may be used. The tarp is black on one side for UV resistance and silver on the other side for reflectivity, and it is reinforced with a nylon mesh.

In the illustrated embodiment, the sheet 70 comprises a netting or open nylon mesh material laminated between polyethylene tarps. For illustration purposes, the nylon mesh is shown, but actual constructions have an upper black surface and a lower silver surface. The sheet 70 should be flexible, but extendable to a flat configuration that reproducibly positions the straps 68 when the web 20 is initially positioned on the substratum 23 in the dike assembly process.

The straps 68 are typically formed of a woven natural or synthetic fiber construction. For example, the straps may comprise a flat woven nylon or polypropylene webbing material of suitable strength. As shown in FIG. 6, the straps 68 are arranged in a right angle crossing pattern with extending pigtails 68*a* and diagonal straps at the corners also include pigtails 68*a*. The straps may be connected to each other at the strap crossover points. The straps 68 are secured to the sheet 70 at the outer crossover points. In this manner, the pigtails 68*a* may be folded onto the sheet 70 without falling into the array of straps 68. Further, the arrangement of the straps in their relative orientation is maintained and the inside perimeter 10*a* of the dike assembly may be accurately positioned along the substratum.

As shown in FIGS. 1 and 6, pin members 48 are provided in widthwise spaced pairs, one pin at the inside flange 34 and one pin at the outside flange 34, at four foot intervals around the inside and the outside perimeters of the dike assembly 19. Accordingly, the straps 68 are arranged with a 4 foot spacing to correspond with the 4 foot spacing between pins 48 in the assembled dike assembly. In this manner, the ends of the pigtails 68*a* lie along the inner perimeter line 10*a* for engagement with the pins 48. In addition, the corner or diagonal straps 68 are positioned at each corner of the web 20 and the outer ends of the corner pigtails 68*a* correspond with the positions of the inner pin 48 of the corner 18.

Figure 6A:
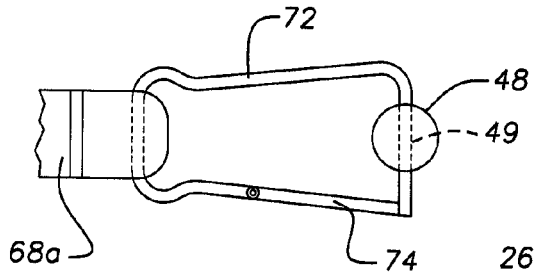
FIG. 6A is a framentary top plan view on an enlarged scale taken along the line 6A in FIG. 6.

For purposes of connecting the straps 68 to the pins 48, a suitable hook connector 72 (FIG. 6A) is secured to the outer end of each pigtail 68*a*. The hook connector 72, sometimes referred to as "Carabineer spring hook", includes a locking or latch mechanism 74 which may be pivoted to an open position for threading the open hook end through the fastening hole 49 in the pin 48. Other styles of hooks may be used including military style J-shape snap hooks having a resilient latch and swivel or non-swivel rectangular connection bases for receipt of the strap ends. Also, various styles of grab or boat hooks, preferably including a latch or closure, may be used.

Figure 7A:
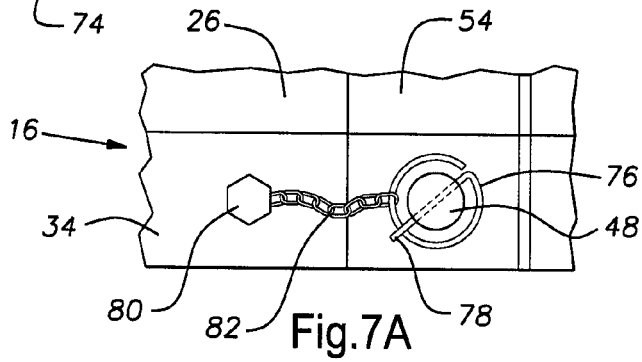
FIG. 7A is a fragmentary top plan view taken along the line 7A-7A in FIG. 7.

It should be appreciated that the hook 72 also serves to lock the overlying flanges together at the sockets 54 and thereby also connect adjacent struts. On the outer side of the dike assembly 10, the pins 48 adjacent the mid-base plates 52 and the sockets 54 are similarly locked by a ring lock 76 (FIG. 7A). The ring lock 76 includes a lock arm 78 received in the fastening hole 49. The lock arm 78 is resiliently biased to the locked position against the circular portion of the ring lock and is thereby retained in the hole 49. As shown, the ring lock 76 may be secured to the flange 34 adjacent the flange hole 50 by a bolt 80 and connecting chain or cable 82 to avoid misplacement of the ring lock during transportation of the disassembled dike.

The construction of the dike assembly 10 begins with the positioning of the alignment web 20 along the substratum 23, preferably in a substantially flat configuration following the contour of the substratum. The ends of the straps 68 extend outwardly so that the hooks 72 define and lie on the inside perimeter 10*a* the assembly. For example, the inside perimeter 10*a* may be a square that is 38 feet on each side, the sheet 70 may also be a square that is 30 feet on each side so that the straps 68 and hooks 72 extend four feet beyond the sheet edges to overlie the inside perimeter. Accordingly, along opposed sides 14 of dike 10, the male and female connector ends 28 and 30 of five struts 16, each having a length of eight feet, and they are engaged to form each dike wall 14. This size dike assembly receives a 20,000 gallon pillow-shape flexible container such as the primary container 12.

Figure 7:
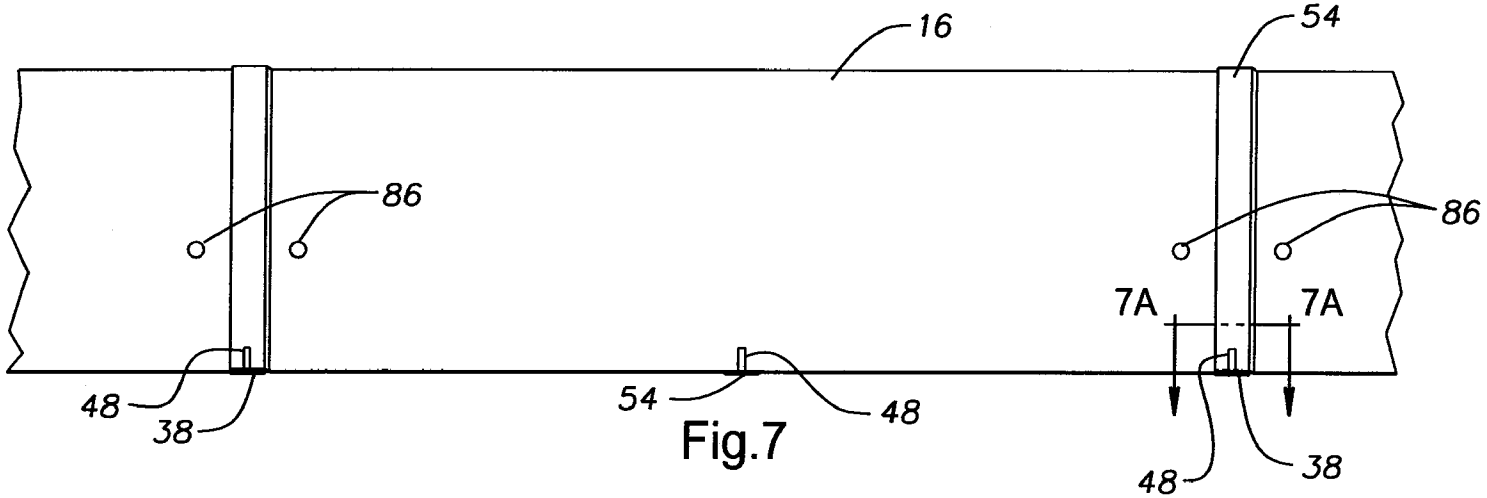
FIG. 7 is a side elevational view of a portion of the dike wall of FIG. 1 as viewed from outside the dike assembly.

As shown in FIGS. 7 and 7A, the pin members 48 at the male connector end 28 of the strut 16 are engaged within the flange holes 50 extending through the flanges 34 of the joined female connector end 30. The corner members 18 are connected to adjacent male and female connector ends 28 and 30 of the perpendicular dike walls 14. More particularly, the pin members 48 of the adjacent male end 28 are engaged within flange holes 50 of the corner member and, similarly, the pin 48 carried by the corner plate 18*b* is received in the flange hole 50 of the female end 30 of the adjacent strut 16.

The hooks 72 are connected to the inside pins 48 to lock the dike walls 14 to the web 20 and to secure the struts 16 and corners 18 together. The outside pins 48 adjacent the mid-base plates 52 and the sockets 52 are secured with the ring locks 76 to further lock the struts 16 and corners 18 together.

After the dike has been constructed, the barrier film or sheet 22 is positioned over the alignment web 20 and extended outwardly along and over the dike walls 14 to provide a fluid impermeable barrier. The sheet 22 may be secured to the dike walls 14 or to the substratum on the outside of the dike. The primary container 12 is then positioned on the sheet 22 within the dike assembly and filled with the fluid to be contained.

If the primary container 12 leaks or ruptures, the fluid therein is contained within the dike by the barrier sheet 22. In the case of a sudden rupture of the container 12, the elevated local force or pressure of the escaping fluid against the dike wall 14 at the rupture cite is resisted by the cooperative action of the struts and corners in their locked together arrangement as well as the alignment web which further secures the struts and corners together adjacent the inside perimeter 10*a* of the dike assembly.

Following the use of the dike assembly 10 at a particular location, it may be readily disassembled and transported to a new location. The hooks 72 and the ring locks 76 are disconnected from the pins 48. Of course, several of the struts 16 may be disconnected to permit the primary container 12 to be removed initially through the resulting opening in the dike wall 14.

The barrier sheet 22 may then be folded to a generally flat configuration. The pigtails 68*a* are folded into the web 20, and then the web 20 is folded to a flat shape with the pigtails enclosed within the folded layers of the web. Thereafter, the remaining struts 16 and the corners 18 are moved apart in preparation for stacking of the struts.

Figure 8:
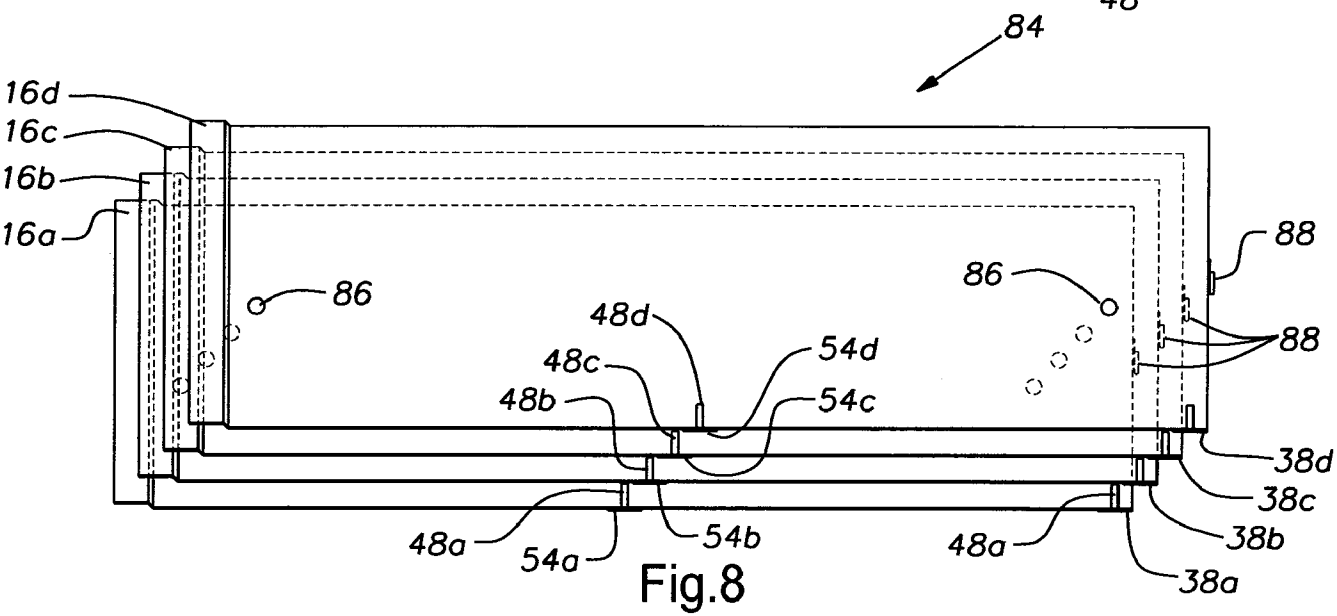
FIG. 8 is a side elevational view of stacked struts in a nested arrangement ready for storage or transportation.

Referring to FIG. 8, a nested stack 84 of four struts 16 is shown. For convenience, the struts are numbered 16*a*, 16*b*, 16*c*, and 16*d*. In a like manner, the components of the respective struts are marked with similar letter designations.

Figure 9:
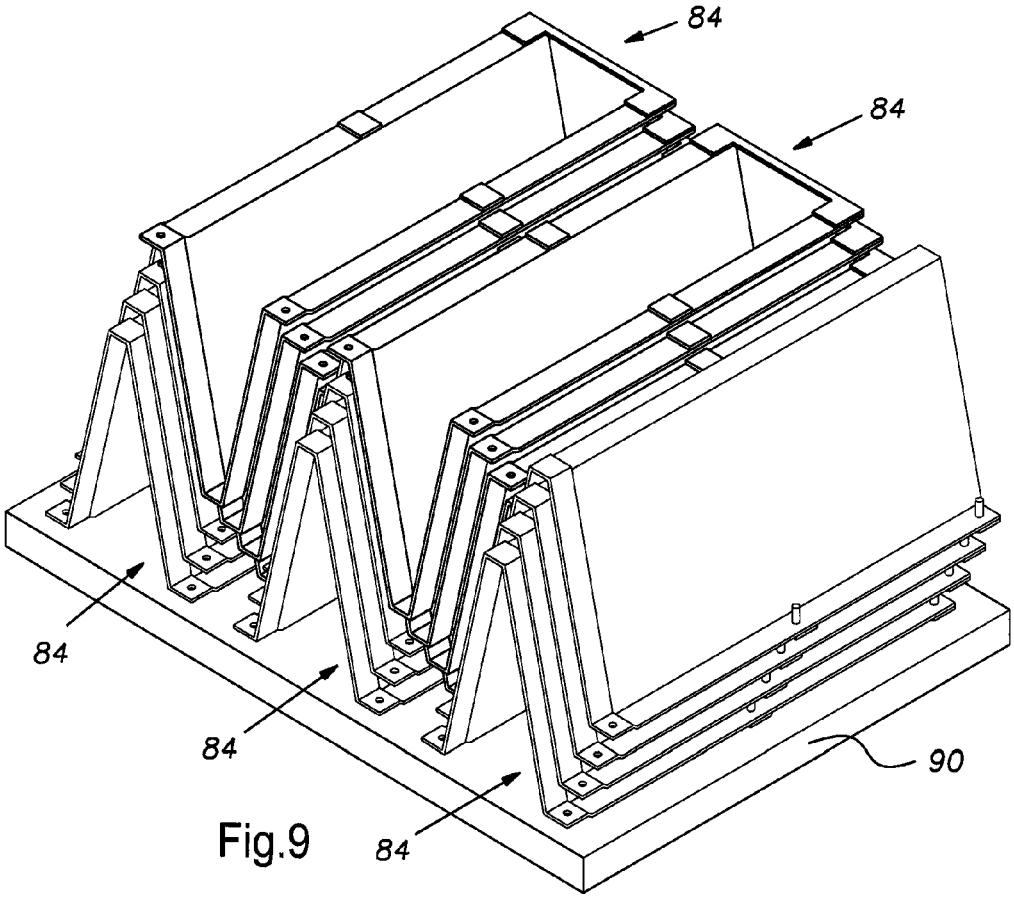
FIG. 9 is an isometric view of the struts of FIG. 1 disassembled and stacked in a nested arrangement on a skid for transportation.

The strut 16*a* is initially positioned on the substratum or other support such as a pallet or skid 90 (FIG. 9). For convenience, four workers may carry each strut by extending polls (not shown) through opposed carry-holes 86 in the sidewalls 26 of the struts.

The open female end 30*b* of a second strut 16*b* is positioned over the male end 28*a* of the strut 16*a* to nest the two struts. The strut 16*b* is pushed into engagement with the strut 16*a* until the end bracket 38*b* engages the male end 28*a* so that the linear or lengthwise offset is about 2". At that point, the associated pins 48*a* of the strut 16*a* respectively engage the lower surfaces of the end brackets 38*b* and the mid-base plate 52*b* of the strut 16*b* which are sized to accommodate the 2" offset. The strut 16*b* is thereby rigidly supported in spaced relationship from the strut 16*a* with limited flexing of the female ends 30*a* and 30*b* toward each other.

The stacking procedure is repeated so as to stack or nest each of struts 16*c* and 16*d* onto the adjacent lower strut. Each of the struts is rigidly supported in spaced relationship from the adjacent lower strut.

The rigid support in spaced relationship of adjacent nested struts inhibits, if not eliminates, frictional interlocking by flexing engagement of the overlying strut portions. As a result, each of the nested struts 16*a* through 16*d* may be sequentially, readily disengaged by pulling a handle 88 (FIGS. 4 and 8) mounted to the strut end wall 36 of the male connector end 28. That is, the struts 16 are disengaged by sliding movement with the pins 48 traveling along the flange 34, the mid base plate 52 and/or the end bracket 36. Referring to FIG. 9, the twenty struts 16 forming the dike assembly 10 are shown stacked on the pallet or skid 90 for transportation or storage. The skid 90 may be a standard 8'×9.5° military skid, and the loaded skid may be transported by truck, plane or rail.

As shown, the twenty struts 16 that form the dike assembly 10 are arranged on the skid 90 in five nested stacks 84 that each contain 4 struts. More particularly, the twenty struts are arranged in three "upright" nested stacks 84 and two inverted nested stacks 84 that are fitted between the three upright stacks. In this manner, the stacked struts are further compacted by positioning an inverted stack 84 within the triangular space between adjacent upright stacks 84.

The four corners 18 may be placed on top of the inverted stacks. Thus, a single skid may conveniently and compactly carry the dike assembly 10 which is of a sufficient size to receive a primary container comprising a 20,000 gallon flexible fuel bladder.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A rapidly deployable modular dike assembly comprising in combination strut members and corner members connectable to form a dike wall, each of said strut members having a top wall, widthwise spaced walls, an open base and lengthwise opposed first and second connector ends, said first and second connector ends of adjacent strut members being engageable to form said dike wall of said dike assembly, said corner members having angularly opposed first and second connector ends engageable with adjacent first and second connector ends of said strut members to form a closed dike corner of said dike assembly, one of said first and second connector ends of said strut members having projecting means for interlocking with receiving means provided by the other of said first and second connector ends of said strut members and said corner members for securing said members together, to form said dike wall of said dike assembly, said strut members being stackable with the top of one of said strut members being received in the open base of another of said strut members to nest said strut members for storage or transportation with the nesting engagement of said stacked strut members being limited by said projecting means, said projecting means engaging adjacent strut members to vertically space nested strut members.

2. The dike assembly of claim 1, wherein said projecting means include a rigid member projecting from a lateral surface of a lower nested strut member and engaged with a corresponding lateral surface of an adjacent upper nested strut member.

3. The dike assembly of claim 2, wherein said projecting means comprise a plurality of said rigid members, said rigid members being arranged in pairs spaced widthwise with respect to said strut member for engagement in associated pairs of said receiving holes to provide widthwise alignment of adjacent strut members to form said dike wall of said dike assembly.

4. The dike assembly of claim 3, wherein said projecting means further comprise a reinforcing element extending widthwise along the bottom of said strut member and supporting said rigid members at spaced widthwise locations.

5. The dike assembly of claim 4, wherein said reinforcing element provides said lateral surface for engaging said rigid member of said lower nested strut member.

6. The dike assembly of claim 5, wherein each of said strut members includes a second pair of widthwise spaced rigid members that are also spaced lengthwise from said first mentioned pair of rigid members.

7. The dike assembly of claim 6, wherein said rigid members and reinforcing elements are formed of metal.

8. The dike assembly of claim 7, wherein said strut members and corner members are formed of resin reinforced with glass fiber and said metal rigid members and reinforcing members are secured to said glass fiber reinforced resin.

9. A rapidly deployable modular dike assembly comprising in combination strut members and corner members connectable to form a dike wall, each of said strut members having a top wall, widthwise spaced walls, an open base and lengthwise opposed first and second connector ends, said first and second connector ends of adjacent strut members being engageable to form said dike wall of said dike assembly, said corner members having angularly opposed first and second connector ends engageable with adjacent first and second connector ends of said strut members to form a closed dike corner of said dike assembly, one of said first and second connector ends of said strut members having projecting means for interlocking with receiving means provided by the other of said first and second connector ends of said strut members and said corner members for securing said members together, to form said dike wall of said dike assembly, said strut members being stackable with the top of one of said strut members being received in the open base of another of said strut members to nest said strut members for storage or transportation with the nesting engagement of said stacked strut members being limited by said projecting means, further including an alignment web detachably connected to said projecting means to secure said strut and corner members of said dike assembly together, said alignment web being flexible and including a plurality of elongate members secured together in an array with member ends positioned along an inside or interior perimeter of said dike assembly for detachable connection to said projecting means.

10. The dike assembly of claim 9, wherein said elongate members angularly intersect in said array to form cross-over points, and said elongate members are secured together at said crossover points.

11. The dike assembly of claim 10, wherein said elongate members are secured to a flexible sheet member which fixes the elongate members in said array with the member ends positioned along said inside or interior perimeter of said dike assembly.

12. The dike assembly of claim 11, wherein said elongate members comprise strap members and said member end comprise hinged connectors fixed to the ends of the strap members adjacent said inside or interior perimeter for detachable connection to said projecting means.

13. A rapidly deployable modular dike assembly comprising in combination strut members and corner members connectable to form a dike wall, each of said strut members having a top, widthwise spaced walls, an open base and lengthwise opposed first and second connector ends, said first and second connector ends of adjacent strut members being engageable to form said dike wall of said dike assembly, said corner members having angularly opposed first and second connector ends engageable with adjacent first and second connector ends of said strut members to form a closed dike corner of said dike assembly, one of said first and second connector ends of said strut members being closed and the other of said connector ends being open, one of said first and second connector ends of said strut members has projecting means for interlocking with receiving means provided by the other of said first and second connector ends of said strut members and said corner members for securing said members together, said strut members being stackable with the top of one of said strut members being received in the open base of another of said strut members to nest said strut members for storage or transportation in a stack, adjacent upright stacks of said strut members forming between them an inverted triangular spacing sized for receiving an inverted stack of struts, and an inverted stack of said struts positioned between the adjacent upright stacks.

14. The dike assembly of claim 13, wherein said projecting means engage adjacent strut members to vertically space nested strut members.

15. The dike assembly of claim 14, wherein said first connector end is closed and provides a reinforcing element extending widthwise along the bottom of said strut member supporting rigid members at spaced widthwise locations, and said projecting means comprise a plurality of rigid members spaced widthwise with respect to said strut member to assure widthwise alignment of adjacent strut members.

16. A rapidly deployable modular dike assembly comprising in combination strut members and corner members connectable to form a dike wall and an alignment web to secure said dike assembly together, each of said strut members having a top, widthwise spaced walls, an open base and lengthwise opposed first and second connector ends, said first and second connector ends of adjacent strut members being engageable to form said dike wall of said dike assembly, said corner members having angularly opposed first and second connector ends engageable with adjacent first and second connector ends of said strut members to form a closed dike corner of said dike assembly, one of said first and second connector ends of said strut members having projecting means for interlocking with receiving means provided by the other of said first and second connector ends of said strut members and said corner members for securing said members together to form said dike wall in said dike assembly, said alignment web detachably connected to said projecting means to secure said strut and corner members of said dike assembly together, said alignment web being flexible and including a plurality of elongate members secured together in an array with member ends positioned along an inside or interior perimeter of said dike assembly for detachable connection to said projecting means.

17. The dike assembly of claim 16, wherein said elongate members angularly intersect in said array to form crossover points, and said elongate members are secured together at said crossover points.

18. The dike assembly of claim 17, wherein said elongate members are secured to a flexible sheet which fixes the flexible members in said array with the member ends positioned along said inside or interior perimeter of said dike assembly.

19. The dike assembly of claim 18, wherein said elongate members comprise strap members and said member ends comprise hinged connectors fixed to the ends of the strap members adjacent said inside or interior perimeter for detachable connection to said projecting means.

20. A rapidly deployable modular dike assembly comprising in combination strut members and corner members connectable to form a dike wall and an alignment web to secure said dike assembly together, each of said strut members having a top, widthwise spaced walls, lengthwise opposed first and second connector ends, said first and second connector ends of adjacent strut members being engageable to form said dike wall of said dike assembly, said corner members having angularly opposed first and second connector ends engageable with adjacent first and second connector ends of said strut members to form a closed dike corner of said dike assembly, said first and second connector ends of said strut members and said corner members interlocking and having pins for securing said members together to form said dike wall in said dike assembly, said alignment web detachably connected to said projecting means to secure said strut and corner members of said dike assembly together, said alignment web being flexible and including a plurality of elongate members secured together in an array with member ends positioned along an inside or interior perimeter of said dike assembly for detachable connection to said pins.

21. The dike assembly of claim 20, wherein said elongate members angularly intersect in said array to form crossover points, and said elongate members are secured together at said crossover points.

22. The dike assembly of claim 21, wherein said elongate members are secured to a flexible sheet which fixes the flexible members in said array with the member ends positioned along said inside or interior perimeter of said dike assembly.

23. The dike assembly of claim 22, wherein said elongate members comprise strap members and said member ends comprise hinged connectors fixed to the ends of the strap members adjacent said inside or interior perimeter for detachable connection to said pins.

* * * * *